US010167139B2

(12) United States Patent
Frederick et al.

(10) Patent No.: US 10,167,139 B2
(45) Date of Patent: Jan. 1, 2019

(54) SELF-VENTING TRASHCAN SYSTEM

(71) Applicants: Michael A. Frederick, Lebanon, NJ (US); John F. Abreu, Scotch Plains, NJ (US)

(72) Inventors: Michael A. Frederick, Lebanon, NJ (US); John F. Abreu, Scotch Plains, NJ (US)

(73) Assignee: Source Unlimited LLC, Lebanon, NJ (US)

( * ) Notice: Subject to any disclaimer, the term of this patent is extended or adjusted under 35 U.S.C. 154(b) by 249 days.

(21) Appl. No.: 15/330,006

(22) Filed: Jul. 25, 2016

(65) Prior Publication Data

US 2018/0022541 A1 Jan. 25, 2018

(51) Int. Cl.
*B65F 1/06* (2006.01)

(52) U.S. Cl.
CPC ..... *B65F 1/068* (2013.01); *B65F 2210/1815* (2013.01)

(58) Field of Classification Search
CPC ..... B65F 1/068; B65F 2210/1815; B65F 2210/181
USPC ..... 220/495.04
See application file for complete search history.

(56) References Cited

U.S. PATENT DOCUMENTS

| | | | | |
|---|---|---|---|---|
| 4,294,379 | A | 10/1981 | Bard | 220/495.04 |
| 4,715,572 | A | 12/1987 | Robbins et al. | 248/101 |
| 6,015,063 | A | 1/2000 | Poliquin | 220/495.04 |
| 6,594,876 | B1 | 7/2003 | Stastby | 29/401.1 |
| 6,736,281 | B2 | 5/2004 | Joseph | 220/495.04 |
| 7,578,409 | B1 * | 8/2009 | Kulasik | B65F 1/06 220/495.04 |
| 7,635,065 | B1 | 12/2009 | Pottinger | 220/495.04 |
| 7,712,623 | B2 | 5/2010 | Wentz et al. | 220/495.04 |
| 8,074,823 | B1 | 12/2011 | Steidinger, III | 220/495.04 |
| 8,418,873 | B2 | 4/2013 | Kastner | 220/495.04 |
| 9,027,777 | B1 | 5/2015 | Steidinger, III | 220/495.04 |

(Continued)

OTHER PUBLICATIONS

Can-Air trashcan advertisement found at: www.can-air.com.

*Primary Examiner* — Andrew T Kirsch
*Assistant Examiner* — Don M Anderson
(74) *Attorney, Agent, or Firm* — Ernest D. Buff & Associates, LLC; Ernest D. Buff; Margaret A. LaCroix

(57) ABSTRACT

A self-venting trashcan system for use with a trashcan having interior smooth sides and a bottom interior surface has an extruded rigid polymeric strip with an adjustable bend formed on its left and right sides bendable along a thin web for contacting smooth sidewalls of a trashcan. Along its height and perpendicular thereto a plurality of parallel easy-to-fracture lines are provided. The user breaks the polymeric strip to thereby adjust its height to be shorter than the height of the trashcan. The left and right sides of the polymeric strip are attached to the smooth sidewalls of the trashcan by double-sided pressure sensitive adhesive tape, leaving a gap or air entry/exit between the top and bottom of the polymeric strip and the top and bottom surface of the trashcan, respectively. During trashcan liner placement, air pockets are smoothed out. Air moves freely in both directions, entering/exiting, between the polymeric strip and the trashcan, and the trash filled plastic liner is readily removed without tearing or vacuum pull-back.

19 Claims, 14 Drawing Sheets

(56) References Cited

U.S. PATENT DOCUMENTS

| | | | | |
|---|---|---|---|---|
| 2006/0060595 | A1* | 3/2006 | Anderson | B65F 1/068 220/890 |
| 2011/0253723 | A1* | 10/2011 | Kastner | B65F 1/06 220/495.04 |
| 2012/0312828 | A1 | 12/2012 | Herndon | 220/720 |

* cited by examiner

SELF-VENTING TRASHCAN SYSTEM

FIELD OF THE INVENTION

The present invention relates to trash containers; and, more particularly, to a system that is integrated or retrofitted with numerous shapes and types of trash containers to facilitate the installation and removal of plastic trashcan liners.

DESCRIPTION OF THE PRIOR ART

Numerous prior art references relate to prevention of vacuum build up between a trashcan and a filled plastic trashcan liner when the filled trashcan liner is lifted from the trashcan. Structural features employed to release the vacuum are oftentimes ineffective since the geometry attending placement of the trashcan liner is unsuited to address this function.

U.S. Pat. No. 4,294,379 to Bard (hereinafter, "the '379 patent") discloses an apparatus for holding a flexible, collapsible trash liner. A rigid upward vented trash receptacle receives a flexible, collapsible, trash liner and includes along the side walls of the upward vented trash receptacle a plurality of axially aligned and peripherally positioned hollow tubes which are interior to or part of (molded into) the vented trash receptacle's internal walls and open at both ends which terminate approximately 1" interior to the top and bottom of the upward vented trash receptacle. The hollow tubes allow ambient air to be drawn from the top of the tubes to the bottom of the tubes to reduce the vacuum created in the vacant space immediately below the flexible, collapsible trash liner as it is removed from the upward vented trash receptacle and thus facilitate removal of the flexible, collapsible trash liner. At the same time the upward vented trash receptacle will contain leakage of most trash or other material even if the flexible collapsible trash liner breaks as well as most trash or other material without a flexible, collapsible trash liner installed. The '379 patent is taught to be formed by a series of hollow tubes; it does not teach a single chamber integrated into a side wall. The series of hollow tubes are susceptible to becoming clogged with debris, which in turn would diminish the air flow.

U.S. Pat. No. 4,715,572 to Robbins, et al. discloses trash bag retainer and air venting device. This bag retaining and air venting device is attachable to a trash receptacle. The device has at least one channel that preferably has a generally U-shaped, V-shaped or similarly shaped interior cross-section. Means are provided for firmly retaining a plastic bag liner in place with a trashcan or other receptacle and for venting air from between the bag liner and the sidewall of the receptacle. The trash bag retainer and air venting device disclosed by the '572 patent has an air gap between the trashcan liner and the interior walls of the trashcan and communicates with spaces 16 in the trashcan liner retainer. When the trashcan liner is placed within the trashcan air pockets are formed. These air pockets oftentimes do not communicate with the gap 16. Pulling a trash filled plastic liner becomes difficult since vacuum suction prevents the pulling action.

U.S. Pat. No. 6,015,063 to Poliquin (hereinafter, "the '063 patent") discloses a trash can vent system that is securable to a trash can and that includes a vent channel positionable along the interior sidewall of the trash can to prevent the trash can liner from forming a vacuum seal with the interior trash can sidewalls. The vent channel member preferably has a number of vent openings formed there through in connection between a vent channel and the trash can liner facing side of the vent channel member and is adjustable in length. The trash can vent system taught by the '063 patent is placed in the trash can; it is not adhered to the interior of the can. As a result, the vent system of the '063 patent can be readily displaced or knocked-over when the trash bag is either being placed in the can or removed from the can. In either case, the susceptibility to becoming dislodged inherent in the '063 patent device will interfere with venting during removal of the trash bag.

U.S. Pat. No. 6,594,876 to Stastby discloses a method and kit for modifying a trashcan to prevent vacuum lock from trashcan liners. This method and kit is operative to modify an existing trashcan and minimize or prevent the occurrence of a vacuum seal that may occur when a trashcan liner is pulled out of the trashcan. The method comprises making three holes substantially close to each other at a point in a trashcan wall near the opening of the trashcan. One end of a conduit is then threaded through one of the holes so that the first end of the conduit reaches deep within the inside of the trashcan and the other end of the conduit extends through the hole and outside of the trashcan. The two remaining holes are used to securely mount the conduit onto the inside surface of the trashcan by threading a tie through these two holes and around the conduit. By modifying an existing trashcan by this method, the vacuum seal that is occasionally encountered when pulling the trash liner from a trashcan is avoided; the conduit allows air to freely pass into the bottom of the trashcan. The kit comprises a conduit, a drill bit and a tie. Also disclosed by the '876 patent is a kit for modifying a trashcan to prevent vacuum lock from trashcan liners. This kit relies on positioning a conduit at the bottom of the trashcan so that air can be removed when the trashcan liner is filled with trash. As the trashcan liner is filled with trash, it becomes heavy, and the trashcan liner entirely covers the conduit placed within the trashcan. Entry of air is prevented, causing vacuum generation. The configuration shown in FIG. 2, wherein the bottom of the trashcan liner is above the conduit, is impractical. The weight of the trash placed within the trashcan liner would essentially seal off the end of the conduit.

U.S. Pat. No. 6,736,281 to Joseph discloses a vacuum-release waste receptacle. This vacuum-release waste receptacle is designed to prevent vacuum adherence of a plastic liner disposed within the present receptacle upon removal of the liner. A plurality of air baffles formed on the inner sidewalls of the receptacle project inwardly into the interior space of the receptacle and to its bottom wall. The air baffles are fabricated to a predetermined dimension, which is calculated to provide an indentation of sufficient depth in the filled plastic liner to create air conduits between the plastic liner, the air baffles, and the inner surface of the receptacle. The air conduits permit the ingress of atmospheric air into the receptacle providing for vacuum-release of the plastic liner upon its removal. Various alternative embodiments of the present waste receptacle are disclosed, featuring different configurations of the air baffles. Generally disclosed is a vacuum-release waste receptacle. The trashcan has interior L shaped projections that deform the trashcan liner, deforming the flexible liner to create air passage spaces. When the filled trashcan liner is pulled, air rushes in between the trashcan liner and the trashcan interior surface, breaking the vacuum. This concept is unreasonable since the weight of the trash within the trashcan causes the liner to essentially surround the entire projection. Air cannot enter to break the vacuum when a filled trashcan liner is being pulled out. The L shaped projections in the interior of the trashcan interfere with stacking trashcans one inside another, as is commonplace with selling establishments. Such L shaped projections are likely to bend and break during a forced stacking process.

U.S. Pat. No. 7,635,065 to Pottinger discloses a suction free waste receptacle apparatus. This suction free waste receptacle apparatus provides suction relief, whereby a flexible trash bag suction to the apparatus is negated, thereby affording easier bag placement and removal from the apparatus. The apparatus prevents spillage of trash and liquids from a leaking bag. The apparatus combines rigidity with light-weight using a reinforcing rib structure. A plurality of tubes 16 are affixed to the outer surface of the receptacle within reinforcing angled ribs 22. The tubes are open at the top, as shown at 24 and pass through the wall 26 of the waste receptacle, allowing passage of air. When the trashcan liner is filled, the weight of trash essentially seals the tube opening 26 at the bottom, preventing passage of air and breaking vacuum as the filled trashcan liner is pulled out from the waste receptacle.

U.S. Pat. No. 7,712,623 to Wentz et al. (hereinafter, "the '623 patent") discloses a trash receptacle (and method for using the same) that reduces the suction/vacuum effect in the bottom portion of the receptacle as trash bags or polyliners are removed therefrom. The receptacle includes a vent enabling fluid communication from a first chamber section (at the bottom of the receptacle) to a second chamber section which rests above the first chamber section. The invention of the '623 patent teaches a receptacle constructed having a first chamber section configured to receive items, the first chamber section having a first side wall and a bottom wall; a second chamber section located above the first chamber section, wherein the second chamber section has a second side wall and an internal width that is wider than an internal width of the first chamber section; and a vent providing fluid communication between the second chamber section and a bottom area of the first chamber section, wherein the vent is formed by first, second, third, and fourth outward protrusions along an outer periphery of the first side wall and each protrusion includes two side surfaces. The '623 patent is taught to be formed by a series of outward protrusions along an outer periphery; it does not teach a single chamber integrated into a side wall. The series of outward protrusions are susceptible to becoming clogged with debris, which in turn would diminish the air flow.

U.S. Pat. No. 8,074,823 to Steidinger III, John H. (hereinafter, "the '823 patent") discloses a vacuum release device for assisting removal of plastic bags from containers. The device is a channel made from non-porous materials. The channel has multiple segments and is capable of being attached to both the sidewall and the bottom wall of a container. As the channel is attached to the walls of the container, an air conduit is formed to provide air conduction in the container. The attachment methods comprise mechanical, chemical, and adhesive. The channel has openings at the container's bottom wall and at the corner between the container's sidewall and bottom wall. The unique structure of the channel protects the openings from being blocked by a plastic liner. The '823 patent teaches a device constructed channel comprises an elongated base wall which has a bendable portion between the segments. Segment adheres to the bottom of the trashcan; while segment adheres to the sidewall of the container. Because segment adheres to the bottom of the trashcan, the user must bend into the trashcan to secure the bottom segment. Moreover, the segment will be crushed or deformed if heavy items are in the trash bag and press down upon segment. Also, see non-patent literature found at https://www.youtube.com/watch?v=UNza3rvafM and www.can-air.com.

U.S. Pat. No. 8,418,873 to Kastner (hereinafter, "the '873 patent") discloses a vented trash receptacle having integral or insertable elongated rectangular panels, which can be flat or convex. The panels create vertical airways along the corners or sides of the trash receptacle, such that air can enter at the top of the panel and flow down the sides of the receptacle and into the bottom below the liner bag. To prevent obstruction of the airway by the liner, the vent panel can be perforated at intervals along its length, and/or it contains a vent opening at its lower edge. The '873 patent is taught to be formed by a series of rectangular panels; it does not teach a single chamber integrated into a side wall. The series of rectangular panels are susceptible to becoming clogged with debris, which in turn would diminish the air flow. U.S. Pat. No. 9,027,777 to Steidinger, III (hereinafter, "the '777 patent") discloses a vented trash container with a manifold of air channels. This vented trash container with a manifold of air channels is capable of distributing air throughout the entire container. The vented trash container is capable of eliminating vacuum between walls of the container and a liner. The manifold in the container comprises a plurality of air channels and an air distributing means. The manifold forms a network of the air channels so as to provide air distribution throughout the entire container and enhance reliability of the air distribution. The vented trash container with the manifold can be cast from a single piece of a material to form an integrated seamless unit, and easily manufactured by a single injection molding process. The flexible trashcan liner is placed within the interior of the vented trash container. When a trashcan liner is weighted with trash, the flexible trashcan liner can close off the circularly looping channel 28. Access of atmospheric air through vertical channels 15 is thereby prevented, in turn, creating vacuum generation when the filled trashcan liner is pulled. The vented trash container with a manifold of air channels is not a standard trashcan with a smooth interior; and is expensive to manufacture. Injection molding of the vented trash container with a manifold of air channels in the bottom is difficult. The part is not easily removed from an injection mold, and requires multiple die tools that are articulated.

U.S. Patent Application Publication No. 2012/0312828 to Herndon (hereinafter, "the '828 publication") discloses a vent device having an elongate body having a main body of one or two members with a top end and a bottom end, an elongate side member on each side of the main body being bent inward the same direction, and a suspension clip formed on an end of each elongate side member for suspending the vent device from the rim of a trash container. When formed of two members comprising an upper member and lower member, the lower body member includes preformed clips for attachment through slots on the upper body member and the length of the device is determined by the slots selected for insertion of the clips. The main body may include score lines for breaking off portions of the main body and adjusting the length of the device to fit the height of a trash container. The '828 publication's vent device includes a flexible elongate body and suspension hangers; in another embodiment the '828 publication discloses that the device may be modified by adding a back side on the main body between each side member to enclose the vent's elongated body, forming a tubular body. In addition, the main body may be modified so that instead of suspension hanger the device includes flange members to form a back face with an adhesive. The '822 publication's vent device, when constructed with flange members, results in the flanges visa via a back face of the elongated body wherein the body thus form a tubular body. In this manner air passes through the body or tub; it does not pass between the wall of the trashcan and the body of the device, as a result the tube is susceptible to being crushed and the air flow disrupted.

Based on the foregoing, there exists a need in the art for an easy to use trashcan attachment that prevents vacuum pullback when a trash filled heavy trashcan liner is lifted out from a trashcan prior to disposal. Further, there is a need in the art for a trashcan attachment that utilizes the interior wall or walls of the trashcan to create a void space or channel for air exchange. Still further, there is a need in the art for a trashcan attachment that is not susceptible to crushing, bending or shifting, to avoid interruption and/or closing off of the void space or channel for air exchange.

SUMMARY OF THE INVENTION

The present invention provides a system for releasing the vacuum that is generated when a trash filled plastic liner is lifted out from a trashcan with smooth interior walls. The presence of the vacuum increases the effort to pull out the trash filled plastic liner from the trashcan, and may apply enough stress to break or tear the plastic liner material, spilling the trash. The present invention uses a bent, rigid polymeric strip that contacts the smooth interior wall of the trashcan on the left and the right sides. The polymeric strip is secured to the interior side walls of the trashcan, and does not extend on the bottom floor or wall of the trashcan, by two pieces of double-sided pressure sensitive adhesive tape, while maintaining a gap between the polymeric strip and the bottom interior surface of the trashcan. As the trashcan liner is filled with trash, it becomes heavy and essentially rests on the bottom of the trashcan, keeping the gap between the rigid plastic strip and the bottom of the trashcan unblocked. The strip does not traverse the bottom of the trashcan in order to ensure that the heavy trash does not crush the strip and interrupt air flow. Air enters the trashcan through the space between the rigid plastic strip and the smooth side wall of the trashcan. The air passes through the gap at the bottom of the rigid plastic strip and enters the interior of the trashcan, releasing any vacuum formed as the trash filled trashcan liner is lifted from the trashcan.

This feature of vacuum release can be integrally formed in a manufactured trashcan. A polymeric molded trashcan typically has smooth interior and exterior surfaces and is molded in a polymeric molding machine. In this embodiment, the rigid polymeric strip may be molded in the interior wall surface of the trashcan. Conversely, where reentrant surfaces cannot be easily formed using this polymeric molding machine since clear withdrawal is often needed from the parting line, a second piece may be molded similar to the rigid polymeric strip which has a gap present at the bottom and is adhesively bonded to the polymeric molded trashcan. Stack ability of the self-venting trashcan is made possible by having an inclined edge of the trashcan, which clears the self-venting polymeric bonded piece and can be used in the display of a retail selling facility. Clearly, adjacent pieces have to be rotated with respect to each other so that the inclined edges clear the self-venting polymeric bonded piece of each of the stacked trashcans.

When the trashcan liner is first placed within a trashcan, a plurality of air pockets are formed, and if they are not removed, the trashcan liner is subject to movement and rolling. The rigid polymeric strip placed within a trashcan creates a gap between the bottom of the trashcan and the rigid polymeric strip. These air pockets are easily removed through the gap between the polymeric strip and the bottom surface of the trashcan, thereby placing the trashcan liner in smooth contact with the interior surface of the trashcan.

In a first embodiment, the self-venting trashcan system for use with a trashcan having interior smooth sides and a bottom interior surface has an extruded rigid polymeric strip with an adjustable bend formed on its left and right sides bendable along a thin web for contacting smooth sidewalls of a trashcan. The left and right sides of the polymeric strip are attached to the smooth sidewalls of the trashcan by double-sided pressure sensitive adhesive tape, the inner side of which is adhesively secured to the polymeric strip and the outer side of which is protectively covered by a carrier composed of paper, film, foil or the like. Attaching the left and right sides of the polymeric strip to the smooth sidewalls of the trashcan leaves a gap or air entry/exit between the top and bottom of the polymeric strip and the top and bottom surface of the trashcan, respectively. During trashcan liner placement, air pockets are smoothed out. A trash filled plastic liner is readily removed without tearing or vacuum pull-back as air moves freely in both directions, air entry/exit, between the polymeric strip and the trashcan.

The subject rigid polymeric strip attaches to the interior wall or walls of the trash can and uses the structure of the can to create a void space or channel for air exchange top to bottom and bottom to top, as opposed to creating a channel that is subject to crushing or bending or shifting, which could lead to a failure by closing off the openings.

The rigid polymeric strip may be made from a number of polymeric materials as well as other materials, including polymer coated wood or metal. The polymer may be Acrylonitrile Butadiene Styrene (ABS), high density polyethylene or polyvinylchloride. The rigid polymeric strip may be an extrusion-molded part. Since the weight of the trash filled trashcan liner pushes against the rigid polymeric strip, it is important that the rigid polymeric strip does not bend along its height. For typical trashcans that are thirteen (13) gallons or less, the rigid polymeric strip has been found to avoid bending along the height. However, it is contemplated that for taller or larger cans the rigid polymeric strip may alternatively include molding of a plurality of ribs on the side opposite to the side which contacts the trashcan liner to help prevent bending.

Various types of thermoplastic resins are contemplated in molding the subject trashcan and/or rigid strip. ABS (Acrylonitrile Butadiene Styrene) is a thermoplastic resin commonly used for injection molding and extrusion applications, and is the preferred composition. ABS Plastic is a copolymer of Acrylonitrile, Butadiene, and Styrene, and generally possesses medium strength and performance at median cost. ABS is a common thermoplastic resin and can often meet the property requirements at a reasonable price, falling between standard resins (PVC, polyethylene, polystyrene, etc.) and engineering resins (acrylic, nylon, acetal, etc.). ABS is considered the best of the styrenic family. It is tough, hard and rigid and has good chemical resistance and dimensional stability. These properties are little affected by temperature and atmospheric humidity in the acceptable operating range of temperatures. The final properties will be influenced to some extent by the conditions under which the material is processed to the product; for example, molding at a high temperature improves the gloss and heat resistance of the product whereas the highest impact resistance and strength are obtained by molding at low temperature. The rigid polymeric strip may be an extrusion-molded part. Since the weight of the trash filled trashcan liner pushes against the rigid polymeric strip, it is important that the rigid polymeric strip does not bend along its height. This is easily accomplished by molding a plurality of ribs on the side opposite to the side which contacts the trashcan liner.

Generally, it is common practice to secure the trashcan liner to the trashcan, using a retention tool. This retention tool is yet to be installed when the trashcan liner is placed within the trashcan and there is no difficulty in expelling air pockets formed, since the air exit pathway is open. Prior to removal of the trash filled trashcan liner, the retention tool must be removed. The edges of the trash filled trashcan liner are gathered to pull out the trashcan liner. During this procedure, the entrance pathway is wide open, pulling ambient air into the interior bottom portion of the trashcan, breaking any vacuum that is formed.

The polymeric strip attached to the sidewalls of the smooth interior of a trashcan has additional advantages. When a trashcan liner is placed within the trashcan, air pockets form and prevent smooth placement of the trashcan liner within the trashcan. The presence of a gap below the plastic strip releases these air pockets by allowing air to exit to the top of the trashcan and out, promoting smooth placement of the trashcan liner.

The subject rigid strip is installed into the trashcan by removing the carrier from the double-sided adhesive tape and securing the sides of the rigid strip to the side wall of the trashcan, thereby forming the air flow channel allowing air entry/exit on both at the top of the strip/trashcan and at the bottom of the strip/trashcan. This allows trapped air to escape when a liner (i.e. trash bag) is being installed in the trashcan, so that the strip is not visible with the liner in the can. When the trash bag is full/ready to be removed, the trash bag liner is simply pulled upward. As the trash bag/liner is pulled upward a vacuum force is created pulling air downward through the channel behind the rigid strip and an air pocket fills under the trash bag/liner so that the bag is readily pulled out from the trash can without tearing of the trash bag.

Briefly stated, the subject invention uses a cut height of extruded and die formed ABS (Acrylonitrile Butadiene Styrene) plastic flat strip. This ABS plastic flat strip is appointed to be attached to the interior of a trashcan using double sided pressure sensitive tapes. A pathway is thereby formed to accommodate entry/exit air trapped between the trashcan liner and the smooth interior of the trashcan, both at the bottom and along the sides of the trashcan interior. Insertion of the trashcan liner inside a trashcan is accomplished with ease. Removal of the trashcan liner filled with trash is accomplished without the usual vacuum pull back that is created between the flexible liner and the trashcan interior. The effort otherwise needed to pull out the heavy trash filled trashcan liner is decreased, and the propensity of the plastic liner to tear and spill trash is virtually eliminated.

In its preferred embodiment, the Self-Venting Trashcan System of the present invention, comprises:

1) a trashcan with a smooth interior;

2) said trashcan having a cylindrical, rectangular, half round, arc shaped wall, parallelogram shape, half oval, oval, square or triangular cross section, standard trashcan shapes, and/or other additional shapes otherwise performing the same trashcan function;

3) an extruded rigid polymeric strip attachable on left and right sides to an interior smooth side of said trashcan by double sided pressure sensitive adhesive tapes forming first air entry/exit pathway;

4) said rigid polymeric strip optionally having ribs or ridges preventing longitudinal bending of the rigid polymeric strip under the pressure applied by trash contained within the trashcan liner. This alternative embodiment has particular applications for use with taller or larger trashcans, such as trashcans taller or larger than thirteen (13) gallons, or wherein extra structural support is needed;

5) said polymeric strip having a height corresponding to a typical height of a trashcan with the rigid polymeric strip having a height x that is slightly shorter than the height y of a wall of a trashcan [y>x]. In an alternative embodiment, the rigid polymeric strip may be constructed to be adjustable by fracture at easy to fracture parallel lines to be smaller than the height of said trashcan, thereby providing a downwardly adjusted air entrance/exit pathway lower than the top of the trashcan; and 6) said downwardly adjusted air entrance/exit pathway allowing trapped air accumulated between said trashcan liner and said trashcan interior during placement of the trashcan liner within the trashcan interior to travel through said downwardly adjusted air entrance/exit pathway to and through said second air entrance/exit pathway;

whereby pulling of the trash filled trashcan liner for disposal is carried out without vacuum pull back, minimizing effort and propensity to tear said trashcan liner during removal, and the trashcan liner is readily placed within smooth sidewalls of a trashcan and easily removed, when full, with reduced effort due to the release of vacuum created between trashcan liner and smooth interior walls of trashcan by entry of air through said second air entrance/exit pathway below said extruded polymeric strip.

A preferred method for using the self-venting trashcan system comprises the steps of:

a) forming a rigid polymeric strip having a height corresponding to a typical height of a trashcan (the rigid polymeric strip having a height x that is slightly shorter than the height y of a wall of a trashcan [y>x]. In an alternative embodiment, the rigid polymeric strip may be constructed so that it can be shortened to the height of the trashcan, said break preferably being made at alternatively included easy-to-break lateral parallel lines displaced longitudinally along opposing sides of the rigid polymeric strip);

b) attaching first sides of segments of a double-sided pressure sensitive adhesive tape to each of left and right bent portions of the rigid polymeric strip (in this step of the method, the first side refers to the side of the double-sided pressure sensitive adhesive tape that is attached to each of the left and right bent portions during the manufacturing process);

c) attaching second sides of the double-sided pressure sensitive adhesive tape segments on both the left and right bent portions of the polymeric strip (in this step of the method, a carrier typically comprised of paper, film, foil or the like, protecting the opposite side of the double-sided pressure sensitive adhesive tape is peeled off by the end user prior to attaching to the inside(s) of the can);

d) securing the rigid polymeric strip against the smooth side walls of the trashcan, leaving a gap between the bottom of the rigid polymeric strip and the bottom interior surface of the trashcan. It is noted that the trashcan can have a plethora of shapes, including rectangular, square, or polygon in general, as well as round, oval, circular, or arced, as well as known and like functional trashcan shapes and designs. In which case, "side walls" herein refers generally to a wall/walls of a trashcan generally without limiting the actual shape of the trashcan itself; which may include several shapes and sizes;

e) placing a trashcan liner within the trashcan fitted with said self-venting trashcan system; and f) smoothening air pockets between the trashcan liner and said smooth interior surface of said trashcan, expelling trapped air through the gap between the bottom of the polymeric strip and the bottom interior surface of the trashcan by pulling air from the top first entry/exit to the bottom second entry/exit as the bag is pulled up and out of the can; and g) filling the trashcan liner with trash and pulling out the trash filled trashcan liner; whereby the trashcan liner contacts the smooth interior of the trashcan without air pockets and can be removed from said trashcan without vacuum pullback. In motion (Dynamic) removal of the liner or trash bag is readily achieved by pulling air from the top first entry/exit to the bottom second entry/exit as the bag is pulled up and out of the can.

BRIEF DESCRIPTION OF THE DRAWING

The invention will be more fully understood and further advantages will become apparent when reference is had to the following detailed description of the preferred embodiments of the invention and the accompanying drawing, in which:

FIG. 1B illustrates a detailed sectional view of the embodiment of FIG. 1A;

DETAILED DESCRIPTION OF THE INVENTION

Figure 1A:
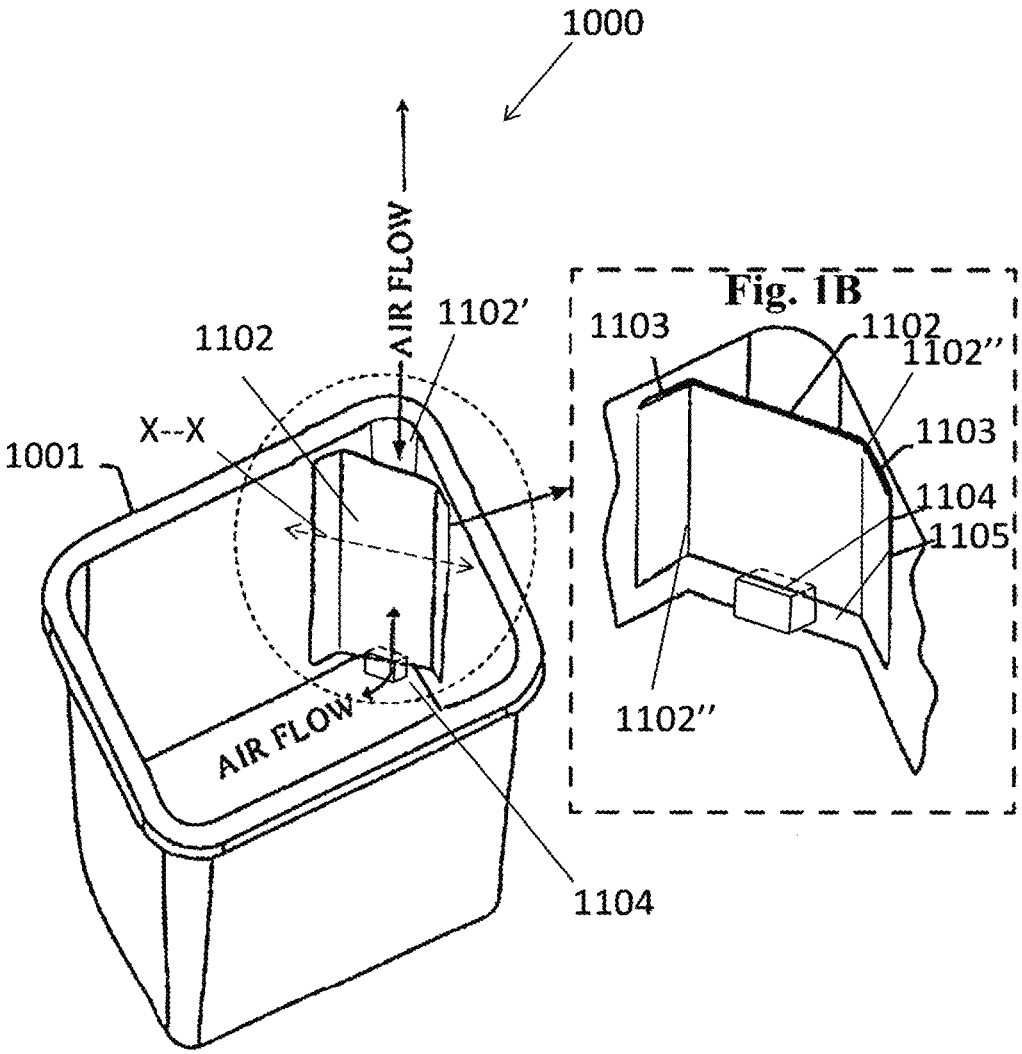
FIG. 1A illustrates an isometric view of an embodiment of the self-venting trashcan system.

This invention relates to a system that allows easy installation of a trashcan liner within a trashcan without the formation of air pockets and resulting or associated vacuum suction problems. Removal of a filled trashcan liner, which may be quite heavy, is oftentimes made difficult by the intimate contact created between the trashcan liner's external surface and the smooth walls of the trashcan interior. Formation of vacuum pockets between the trashcan liner and the smooth interior walls of the trashcan are prevented by the subject self-venting trashcan system, whereby the effort required for removal of the trashcan liner is markedly reduced.

The subject rigid strip (preferably, a rigid polymeric strip) is secured only to the interior side wall or walls of a trashcan leaving a gap or space between the bottom of the rigid strip and the bottom of the trashcan, as well as a gap or space between the top of the rigid strip and the top of the trashcan. The rigid strip does not extend beyond the interior side wall of the trashcan; it does not traverse or otherwise adhere to the bottom of the trashcan, but only the side walls. Any adherence to the bottom of the trashcan would cause the rigid strip to become susceptible to being crushed, which in turn would cause the strip to become dislodged—thereby causing interruption or obstruction of the air flow and cause the device to fail to function in preventing vacuum suction. Several other disadvantages are avoided through the subject self-venting trashcan system, including the subject self-venting system 1) is inexpensive to manufacture and ship because it can be made from a cost effective polymeric material and shipped flat but conditioned to be bent upon use, 2) is securely adhered within the trashcan without risk of being displaced, and 3) can be utilized for a plethora of different shaped and sized trashcans. The objective of the invention is to create a simple easy-to-use, cost effective system that will eliminate the difficulty of insertion and or removal of a trashcan liner within smooth sidewalls of trashcan owing to the formation of air pockets as well as vacuum sticky locations. The self-venting trashcan device uses an extruded and die formed ABS (Acrylonitrile Butadiene Styrene) rigid polymeric strip. Preferably, the rigid polymeric strip has a height corresponding to a typical height of a trashcan, with the rigid polymeric strip having a height x that is slightly shorter than the height y of a wall of a trashcan [y>x]. In an alternative embodiment, the rigid polymeric strip may be constructed so that it can be shortened to the height of the trashcan by way of easy-to-break lateral parallel lines or a plurality of score lines (fracture/perforated lines) extending longitudinally along opposing sides of the rigid polymeric strip). These optional score lines (fracture/perforated lines) allow the strip height x [i.e. height] to be adjusted by tearing away or breaking the strip at the score line to adjust the height of the rigid polymeric strip with respect to the height (i.e. height) of the trashcan. Heights can be customized to any trashcan height by breaking the plastic strip at the optional parallel score lines that are perpendicular to the height direction of the plastic strip.

In general, the height of the rigid polymeric strip cut is shorter than the height of the trashcan, so that when installed, the bottom of the strip leaves a gap to the bottom surface of the trashcan, allowing escape of trapped air or preventing generation of vacuum as the filled trashcan liner is pulled out. The side edges of the rigid polymeric strip have a bent flat surface for easy attachment of the rigid plastic strip against the smooth sidewalls of the trashcan, using double-sided pressure sensitive adhesive strip. Accordingly, the "self-venting trashcan" can be integrated and retrofit into any existing shape or type of trash container of any shape that has smooth internal walls. Preferably the rigid polymeric strip is composed of an ABS plastic. The rigid polymeric strip can be color matched to virtually any color. Preferably, black or white would be a standard color choice.

Various types of thermoplastic resins are contemplated in molding the subject trashcan and/or rigid strip. ABS (Acrylonitrile Butadiene Styrene) is a thermoplastic resin commonly used for injection molding and extrusion applications, and is the preferred composition. ABS Plastic is a copolymer of Acrylonitrile, Butadiene, and Styrene, and generally possesses medium strength and performance at median cost. ABS is a common thermoplastic resin and can often meet the property requirements at a reasonable price, falling between standard resins (PVC, polyethylene, polystyrene, etc.) and engineering resins (acrylic, nylon, acetal, etc.). ABS is considered the best of the styrenic family. It is tough, hard and rigid and has good chemical resistance and dimensional stability. These properties are little affected by temperature and atmospheric humidity in the acceptable operating range of temperatures. The final properties will be influenced to some extent by the conditions under which the material is processed to the product; for example, molding at a high temperature improves the gloss and heat resistance of the product whereas the highest impact resistance and strength are obtained by molding at low temperature. Though the strip being composed of a chemical and solvent resistant composition, such as ABS, provides durability of the strip, it is noted that the strip should not come into contact with solvents if possible as the solvents may cause degradation of the adhesive securing the strip to the trashcan. Because the subject strip is only applied to the side or wall of the trash can, as opposed to traversing the bottom wall of a trashcan, the likelyhood of the strip contacting liquid or solvents leaking through the trash bag is mitigated. On the other hand, liquid or solvent leakage through the trashbag frequently results in leakage through the bottom of the trash bag, and therefore application of the strip on the bottom of the trash can should be avoided as the leaking liquid may adversely affect the adhesive properties.

The pressure sensitive adhesive strip is easy to install and is resistant to temperature changes and various liquids and cleaners. If properly used, the "self-venting trashcan" should never have to come into contact with anything other than water or a cleaner, since it does not come in contact with trash.

Specifically the technology of the "self-venting trashcan" works similar to the operation of a snorkel. It allows air to flow from the top to the bottom of the can unobstructed and also in reverse from the bottom to the top of the can (i.e. it allows the can to "breath"). The "self-venting trashcan" assists the installer or remover of trash bags to avoid the naturally occurring capture of air at the bottom of the can; it removes any vacuum created while attempting to remove a completely filled bag. The void space created below the polymeric strip by the "self-venting trashcan" allows the trapped air to escape to the top of the can, making it possible to seat the bag nicely into the can. This helps avoid the annoying situation where the bag rolls into the can from the top lip the first time you place an object into the can. Likewise when you have a completely filled bag that is applying continuous pressure to all sides of the can, the space created below the rigid polymeric strip of the "self-venting trashcan" device remains unblocked and, much like a snorkel, will pull air from the top of the can to the bottom of the bag, thus releasing any vacuum. This will allow the person servicing the trashcan to easily remove the bag with very little effort. Other than the weight of the filled bag, and any side frictional force (static force), the person will no longer need to struggle with the can to remove a completely filled bag.

The self-venting trashcan has significant advantages. Anyone who has the responsibility of trash bag removal and trash bag installation will greatly appreciate the ease of use. It will make taking out the trash a much more pleasant experience. Employers will like the cost savings and more productive employees. Elderly persons will like the independence and ease of use. No one likes to fight with a filled bag that often tends to rip apart under the strain of pulling against a vacuum. Handicapped or physically disabled will have an easier time and welcome the increased independence. This device has a low manufacturing cost because it can be manufactured using low cost ABS extruded and die formed strips, together with commercially available double sided pressure sensitive tapes, such as foam tapes or other adhesives. The overall cost to manufacture the rigid polymeric strip will be dependent upon the size of the strip which corresponds to the size of can and height of can for which the strip is appointed to be utilized with.

Since the self-venting trashcan system is preferably marketed as an attachment to commonly used trashcans, it does not compromise the stacking ability of trashcans in a selling establishment. The alteration of the interior shape of the trashcan only occurs when the user installs the self-venting trashcan device using strips of double-sided pressure sensitive adhesive tapes to secure the polymeric strip to the smooth surface of the interior wall of the trashcan. Polymeric herein refers to a polymer and is a large molecule, or macromolecule, composed of many repeated subunits, and includes both synthetic and natural polymers. Synthetic plastics such as polystyrene and ABS are preferred in composing the subject polymeric/rigid plastic strip. It is noted that the rigid strip may be composed of other materials as well while still providing a rigid strip that is not susceptible to being crushed during use, such as for example a rigid starch, fiber, or cardboard material. Where composed of cardboard, for example, the rigid strip is preferably only utilized for a single/couple of uses and then it is appointed to be removed and discarded and a new strip applied to the trash can interior. This provides a more environmentally friendly, cheaper and disposable self-venting trashcan rigid strip.

In a first embodiment, the self-venting trashcan system is attachable to a trashcan of any shape which has smooth interior surfaces. It is preferably marketed as a kit comprising: (i) a rigid polymeric strip having left and right sides bendable along a thin web and containing pressure sensitive double sided adhesive appointed to be attached to the interior smooth sides of said trashcan; and (ii) a height setting spacer object appointed to set the rigid polymeric strip off a bottom of the trashcan, to thereby provide a second air entrance/exit pathway between an end of said extruded polymeric strip and the bottom interior surface of said trashcan. The spacer object is preferably composed of a disposable/recyclable material (such as a fiberboard or cardboard material) and is used to set the height off the bottom of the trash can and ease the installation of the rigid strip. In another embodiment, the kit includes an extruded height adjustable polymeric strip with a plurality of parallel easy to fracture lines along its height. Bent portions are provided on left and right sides of the polymeric strip, to facilitate fitting and attachment to the trashcan interior using a double sided pressure sensitive adhesive tape.

In a preferred embodiment a self-venting trashcan system is provided having a smooth rigid plastic strip, preferably ABS plastic, bent tabs on both the left and right side with a thin web to facilitate the bending running the height of part from top to bottom, both left and right sides or tabs contain pressure sensitive double sided tape, tape is on the same side of the part of both tabs, preferably foam PST, straight or blunt 90 deg. cut ends. The kit should include a height setting spacer object (e.g. Styrofoam or cardboard or could even be a plastic geometric shape, preferably disposable or recyclable and preferably able to be also packaged flat). The spacer would be used to easily set the height off the bottom of the can as well as assist in the ease of installation and then be either recycled or discarded. The subject self-venting trashcan system provides a cost-effective device having particular applications for use with 13 gallon kitchen type trash containers or home use trash cans, though heretofore disclosed and utilized and/or future functioning trashcans are contemplated, as well as a wide range of can or receptacle designs.

Figure 1C:
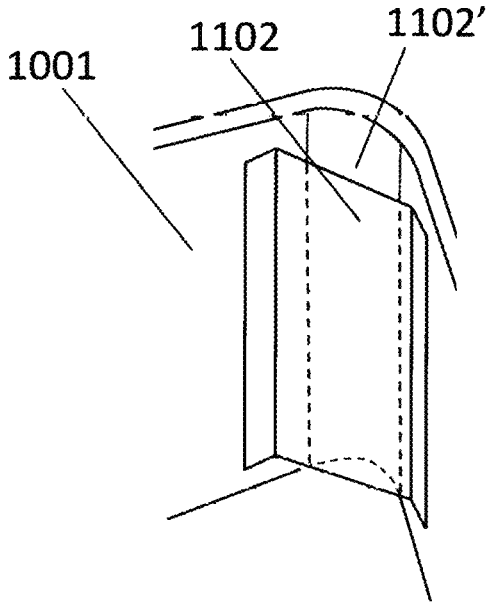
FIG. 1C illustrates a detailed sectional view of the embodiment of FIG. 1A wherein no height setting spacer is utilized.
Figure 1D:
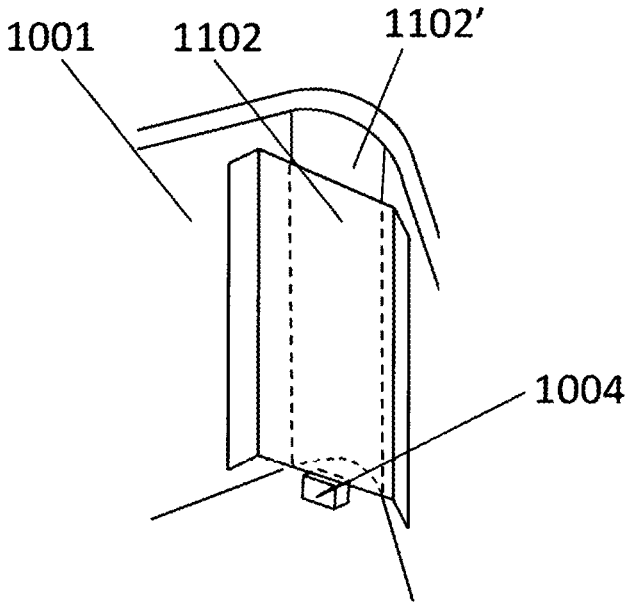
FIG. 1D illustrates a detailed sectional view of the embodiment of FIG. 1A wherein the height setting spacer is being utilized.

FIGS. 1A-1D illustrates a first embodiment of the subject self-venting trashcan system. FIG. 1A illustrates an isometric view of an embodiment of the self-venting trashcan system. FIG. 1B illustrates a detailed sectional view of the embodiment of FIG. 1A. FIG. 1C illustrates a detailed sectional view of the embodiment of FIG. 1A wherein no height setting spacer is utilized. FIG. 1D illustrates a detailed sectional view of the embodiment of FIG. 1A wherein the height setting spacer is being utilized.

Referring to FIGS. 1A-1D, an embodiment of the self-venting trashcan system is shown generally at 1000. A trashcan 1001 is shown generally having a rectangular shape, however a plethora of shaped trashcans can be utilized with the subject self-venting trashcan system. At one corner, an extruded rigid polymeric strip 1102 is adhered to adjacent trashcan 1001 walls forming an air channel 1102', the details of which are shown in the exploded view of FIG. 1B. The rigid polymeric strip 1102 has two edges that bend at a webbing or bend fold line 1102" (forming left and right side portions. The end user bends the strip 1102 at an angle at the webbing or bend fold lines 1102" so that it can contact the two smooth sides of the trashcan 1101. Alternatively, wherein the trashcan has a half round or half oval shape/or other shape, the two edges bend at an angle to contact and bridge the inside wall of the trashcan.

Two pieces of double-sided pressure sensitive adhesive tape are shown at 1103 and are used to secure the rigid polymeric strip 1102 against the smooth interior of the trashcan 1001. The double-sided pressure sensitive adhesive tape may be a foam tape such as that marketed by 3M or others. In the embodiment shown, a height setting spacer 1104 is provided for added support of the rigid polymeric strip 1102 to ensure a gap 1105 between the bottom of the strip and trashcan is preserved during use.

Figure 2A:
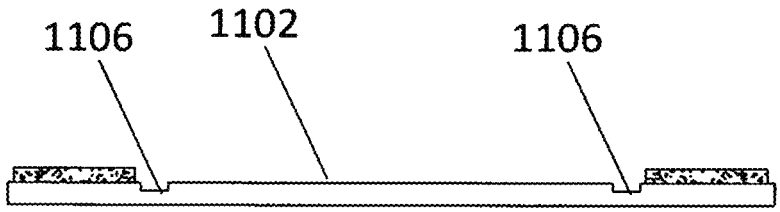
FIG. 2A illustrates a cross-sectional view of the embodiment of FIG. 1A taken along x-x wherein the rigid strip is substantially flat, such as prior to use.
Figure 2B:
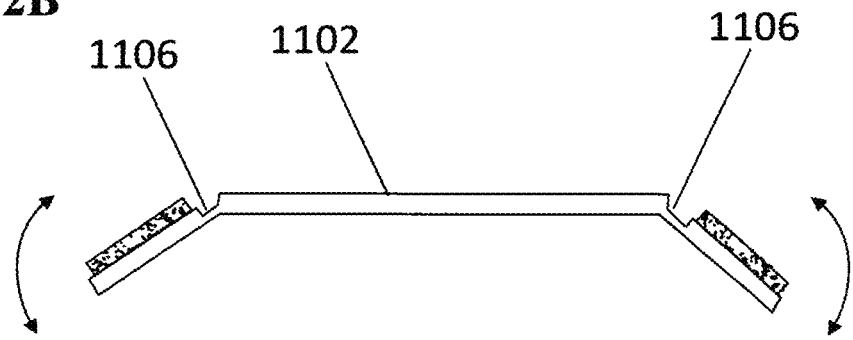
FIG. 2B illustrates a cross-sectional view of the embodiment of FIG. 1A taken along x-x wherein the rigid strip is being bent, such as during application and use.

FIG. 2A-2B illustrate views of the rigid strip of FIG. 1A. FIG. 2A illustrates a cross-sectional view of the embodiment of FIG. 1A taken along x-x wherein the rigid strip is substantially flat, such as prior to use. FIG. 2B illustrates a cross-sectional view of the embodiment of FIG. 1A taken along x-x wherein the rigid strip left and right sides are bent, such as during application and use. The rigid strip 1102 left and right sides have a top and a bottom edge with a thin web 1106 extending from the top edge to the bottom edge to facilitate bending. Thin web 1106 provides flexing lines so that the left and right sides can bend independently of one another and without any risk of deforming the rigid strip 1102. FIG. 2B shows the range of bending motion of the left and right sides to adjust the bend for the best secure attachment suitable for the trashcan shape.

Figure 3A:
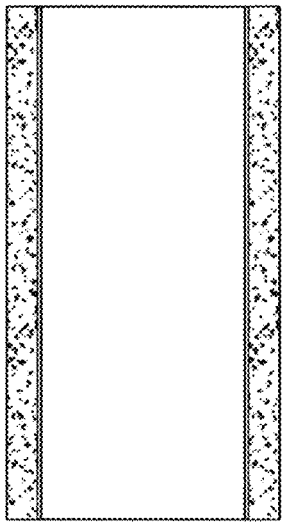
FIGS. 3A-3H illustrate back side views of different structures of the rigid strip of the self-venting trashcan system.
Figure 3B:
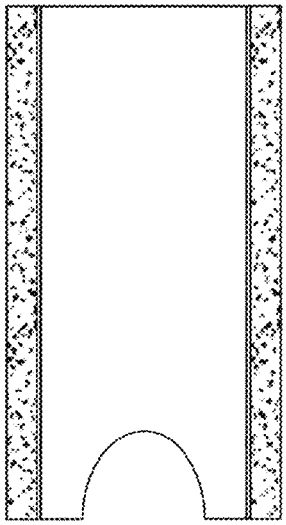
Figure 3C:
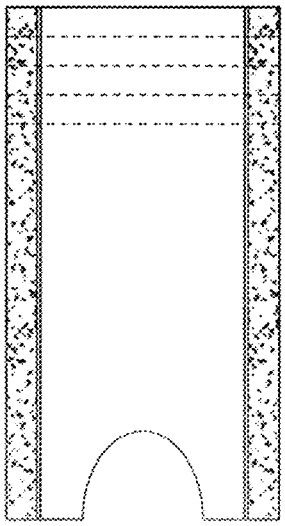
Figure 3D:
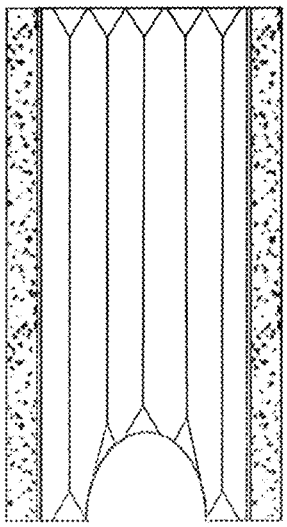
Figure 3E:
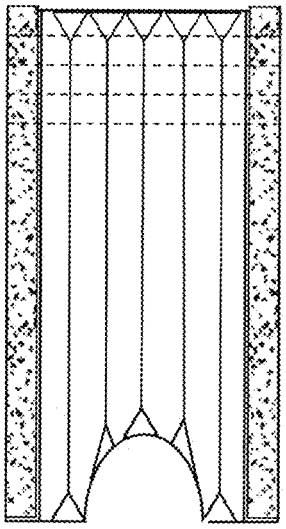
Figure 3F:
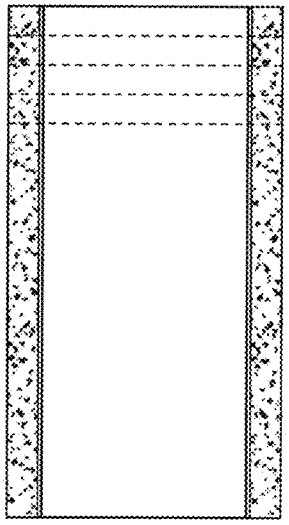
Figure 3G:
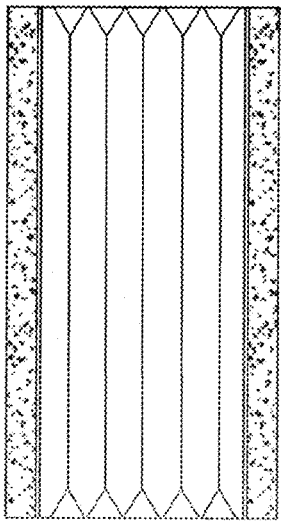
Figure 3H:
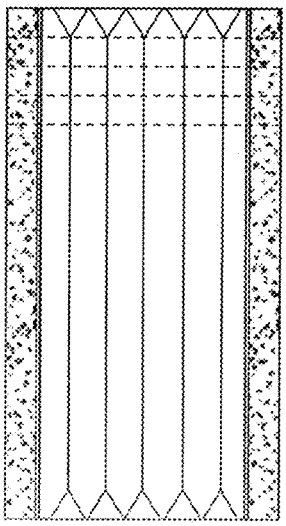

FIGS. 3A-3H illustrates back side views of different structures of the rigid strip of the self-venting trashcan system. The back side view represents the side of the ridged strip facing the trashcan once the strip is installed, or the same side as the PST and the ridges (if used). The front side represents the side of the rigid strip facing the trash bag or liner once the strip is installed, and the side of the ridged strip which would come in contact with the trash bag or liner once bag/liner is installed. FIG. 3A shows an embodiment of the rigid strip wherein the strip has a straight cut (top and bottom), does not contain score lines (discussed hereinafter), and does not contain longitudinal ribs (discussed hereinafter). FIG. 3B shows an embodiment of the rigid strip having a top straight edge and a bottom edge having an arch/or curve with "feet" for resting on a trashcan bottom. FIG. 3C shows an embodiment of the rigid strip having a top straight edge and a bottom edge having an arch/or curve with "feet" for resting on a trashcan bottom with fracture/perforation lines for adjusting the height of the rigid strip. FIG. 3D shows an embodiment of the rigid strip having a top straight edge, elongated ribs, and a bottom edge having an arch/or curve with "feet" for resting on a trashcan bottom. FIG. 3E shows an embodiment of the rigid strip having a top straight edge, elongated ribs, and a bottom edge having an arch/or curve with "feet" for resting on a trashcan bottom with fracture/perforation lines for adjusting the height of the rigid strip. FIG. 3F shows an embodiment of the rigid strip wherein the strip has a straight cut (top and bottom) and contains score lines/fracture/perforation lines for adjusting the height of the rigid strip. FIG. 3G shows an embodiment of the rigid strip having a top straight edge and elongated ribs. FIG. 3H shows an embodiment of the rigid strip having elongated ribs and fracture/perforation lines for adjusting the height of the rigid strip.

Figure 3I:
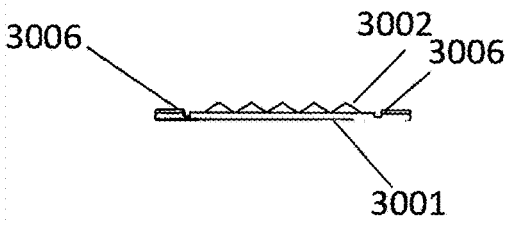
FIG. 3I illustrates a top edge view of the structure of FIG. 3H in order to show a representative view of the ridges along the height direction of the strip of FIG. 3H.

FIG. 3I illustrates a top edge view of the structure of FIG. 3H in order to show a representative view of the ridges 3002 along the height direction of the strip 3001 along with webbing/bend fold line 3006.

Figure 3J:
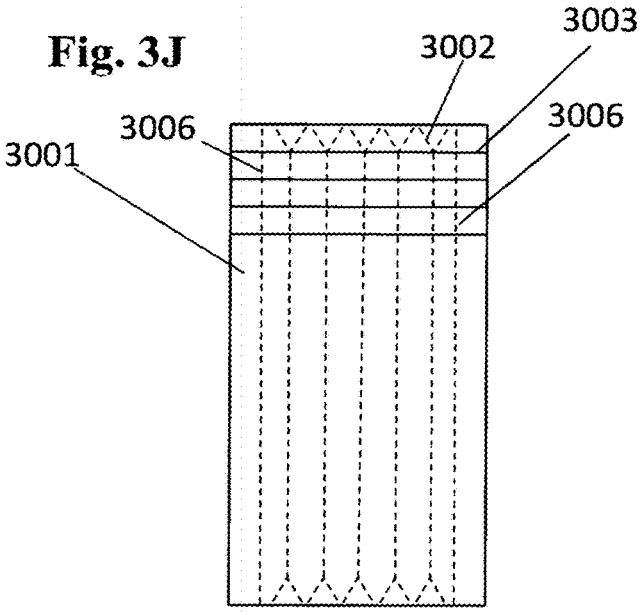
FIG. 3J illustrates a front side view of the structure of FIG. 3H in order to show a representative view of the ridges along the height direction of the strip of FIG. 3H as viewed from the front face of the strip.

FIG. 3J illustrates a side view of the structure of FIG. 3H in order to show a representative view of the ridges 3002 as viewed from the front face of the strip 3001 along with the fracture/perforation lines 3003 and webbing/bend fold line 3006.

Figure 4A:
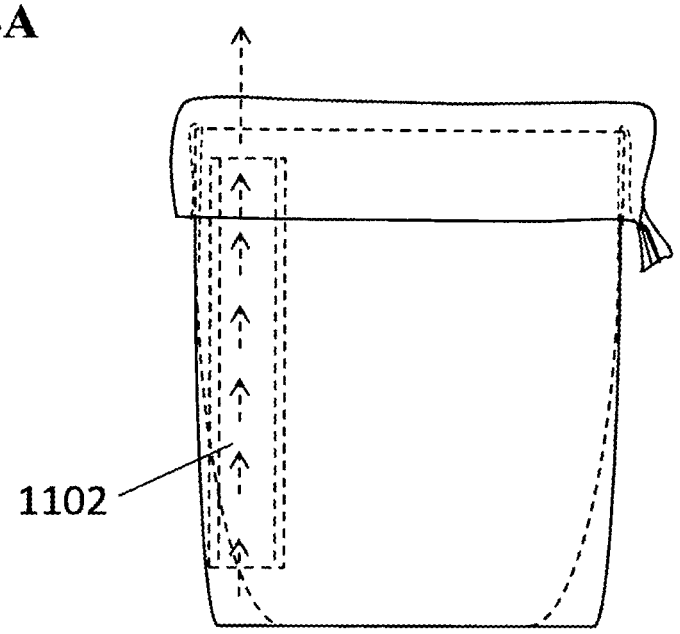
FIG. 4A illustrates a side plan view of a trash can with the rigid strip of FIG. 1A inserted between the trashcan and liner (or bag)
Figure 4B:
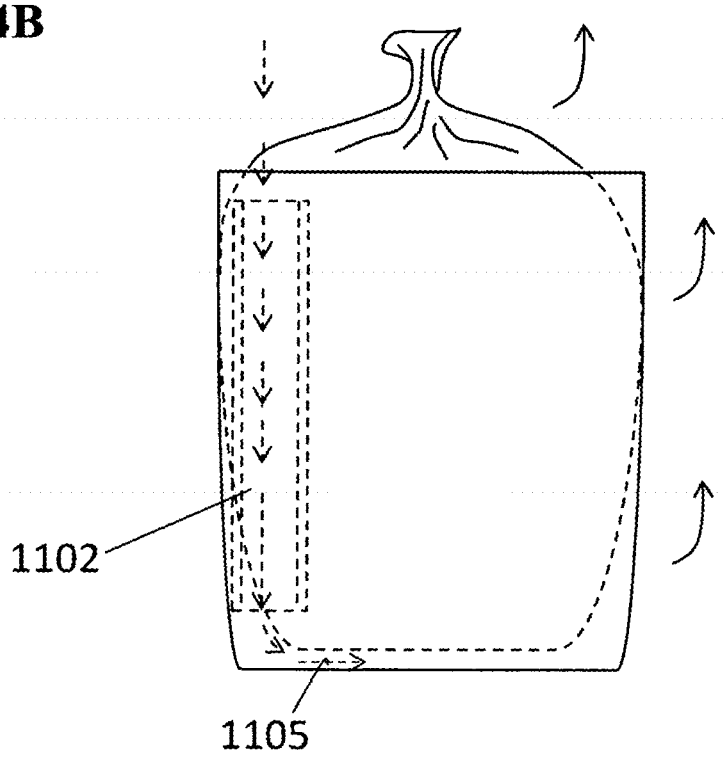
FIG. 4B illustrates a side plan view of a trash can with the rigid strip of FIG. 1A wherein the liner (or bag) is being removed from the trashcan.

FIGS. 4A-4B illustrates the self-venting trashcan system of FIG. 1A in use. FIG. 4A illustrates a side plan view of a trash can with the rigid strip of FIG. 1A inserted between the trashcan and liner (or bag). FIG. 4B illustrates a front side view of a trash can with the rigid strip of FIG. 1A wherein the liner (or bag) is being removed from the trashcan. When the trash bag/liner is being installed the rigid strip 1102 allows trapped air to escape. The rigid strip 1102 is not visible once the liner is placed within the trashcan. During removal of the trash bag or liner, as the trash bag is pulled upward air is pulled into the air channel of the rigid strip 1102 and air enters the space on the bottom of the can, shown at 1105.

Figure 5A:
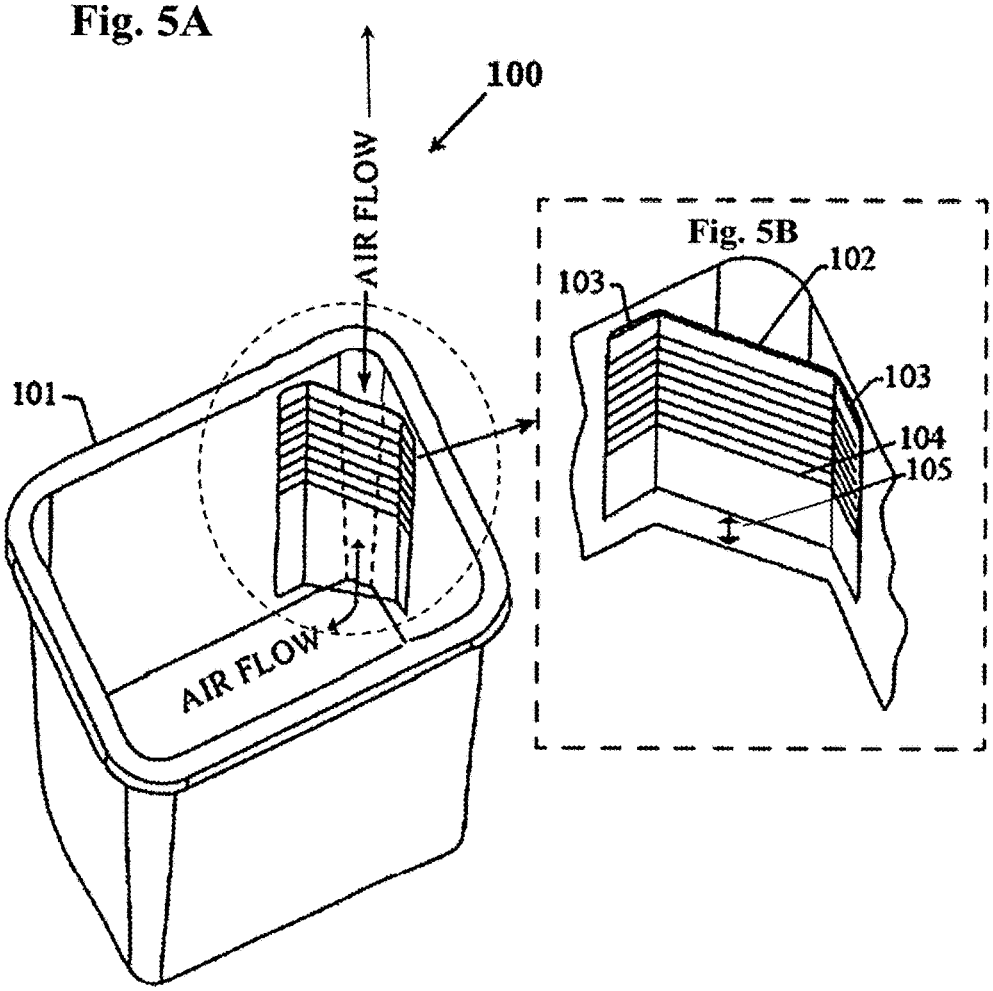
FIG. 5A illustrates an embodiment of the self-venting trashcan system showing key elements of the embodiment with a detailed exploded view at FIG. 5B.

FIG. 5A illustrates an embodiment of the subject invention, shown generally at 100. The typical rectangular trashcan is shown at 101. It is noted that although in the embodiment shown the trashcan is rectangular, the trashcan may have a variety of shapes without departing from the subject invention, including for example half round, half oval and any other available shapes. At one corner, the extruded rigid polymeric strip 102 is placed, the details of which are shown in the exploded view of FIG. 5B. The rigid polymeric strip 102 has two edges that bend at an angle by the end user, so that it can contact the two smooth sides of the trashcan 101. Alternatively, wherein the trashcan has a half round or half oval shape/or other shape, the two edges bend at an angle to contact and bridge the inside walls of the trashcan. Two pieces of double-sided pressure sensitive adhesive tape are shown at 103 and are used to secure the rigid polymeric strip 102 against the smooth interior of the trashcan 101. The double-sided pressure sensitive adhesive tape may be a foam tape marketed by 3M and others. In the embodiment shown, the rigid polymeric strip 102 includes an optional plurality of lateral parallel lines 104 locations at which the rigid polymeric strip may be fractured to adjust the height of the rigid polymeric strip and, if necessary, cut the double-sided pressure sensitive adhesive tape at the breakage points prior to double-sided pressure sensitive adhesive tape attachment. The height of the polymeric strip 102 is adjusted to leave a gap 105 between the bottom of the rigid polymeric tip 102 and the bottom of the trashcan 101.

Figure 6:
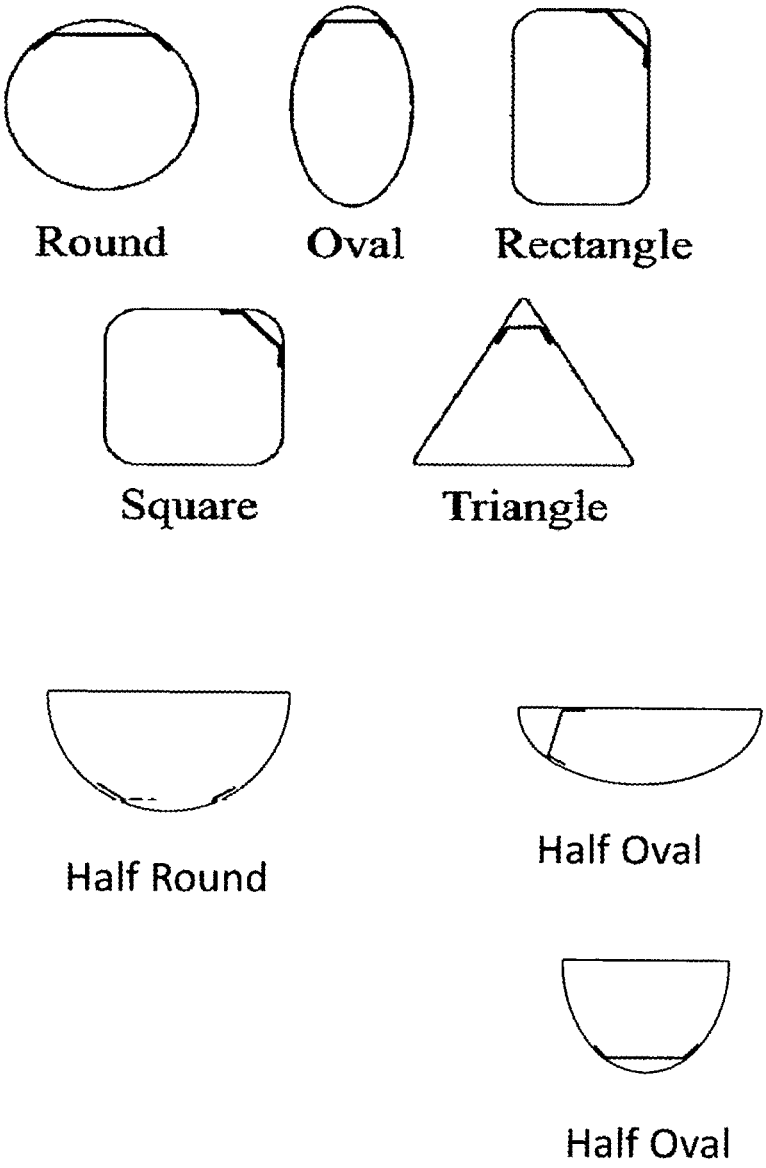
FIG. 6 are schematic illustrations depicting use of self-venting trashcan system with cylindrical, oval, rectangular, square or triangular shaped trashcans.

FIG. 6 depicts schematic illustrations of the use of a self-venting trashcan system, with a cylindrical, oval, rectangular, square or triangular shaped trashcan. As shown, the self-venting trashcan device contacts the smooth interior sides of the trashcan, leaving a space for air entry/exit directly behind the polymeric strip. The polymeric strip does not reach the bottom surface of the trashcan, as shown in FIG. 5A, leaving a gap for entry/exit of air.

Figure 7:
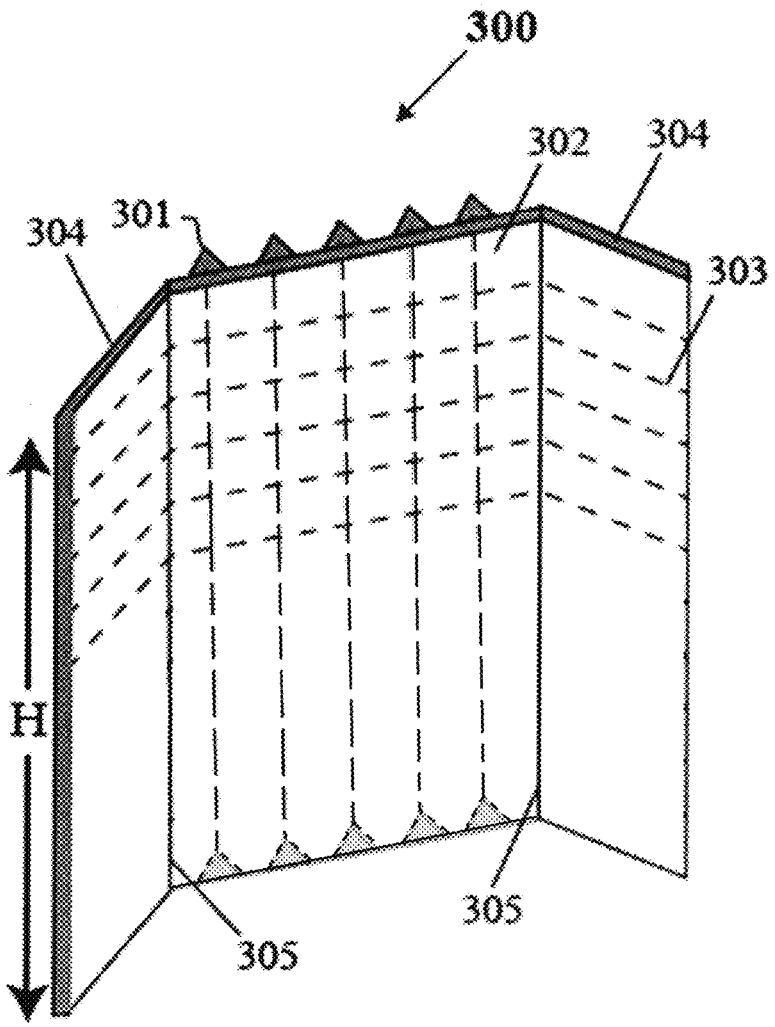
FIG. 7 is an illustration depicting use of the rigid polymeric strip with ridges along the height direction of the strip.

FIG. 7 is an illustration of an embodiment of the rigid polymeric sheet 300 with reinforcing ridges at 301 on the side opposite to side 302 that contacts the trashcan liner preventing the longitudinal flexure or bending of the rigid polymeric strip under the pressure applied by trash contained within the flexible trashcan liner. Although in the embodiment shown there are five (5) reinforcing ridges 301, there are preferably less than five ridges; most preferably there is at least one ridge centrally located on rigid polymeric sheet 300. The reinforcing longitudinal wedges/ribs prevent the bending of the rigid polymeric strip even when trash contained within the trashcan liner exerts pressure. In the embodiment shown, the polymeric strip may be cut to different heights 'H' along the easy to cut lateral parallel lines 303. The height 'H' is smaller than the height of the trashcan, leaving a gap between the bottom of the trashcan and the bottom of the rigid polymeric strip. Since the rigid polymeric strip is attached to the smooth side walls of the trashcan 304 using a double-sided pressure sensitive adhesive tape, the flat left and right portions of the rigid polymeric strip are flexed along flexing lines 305.

Figure 8A:
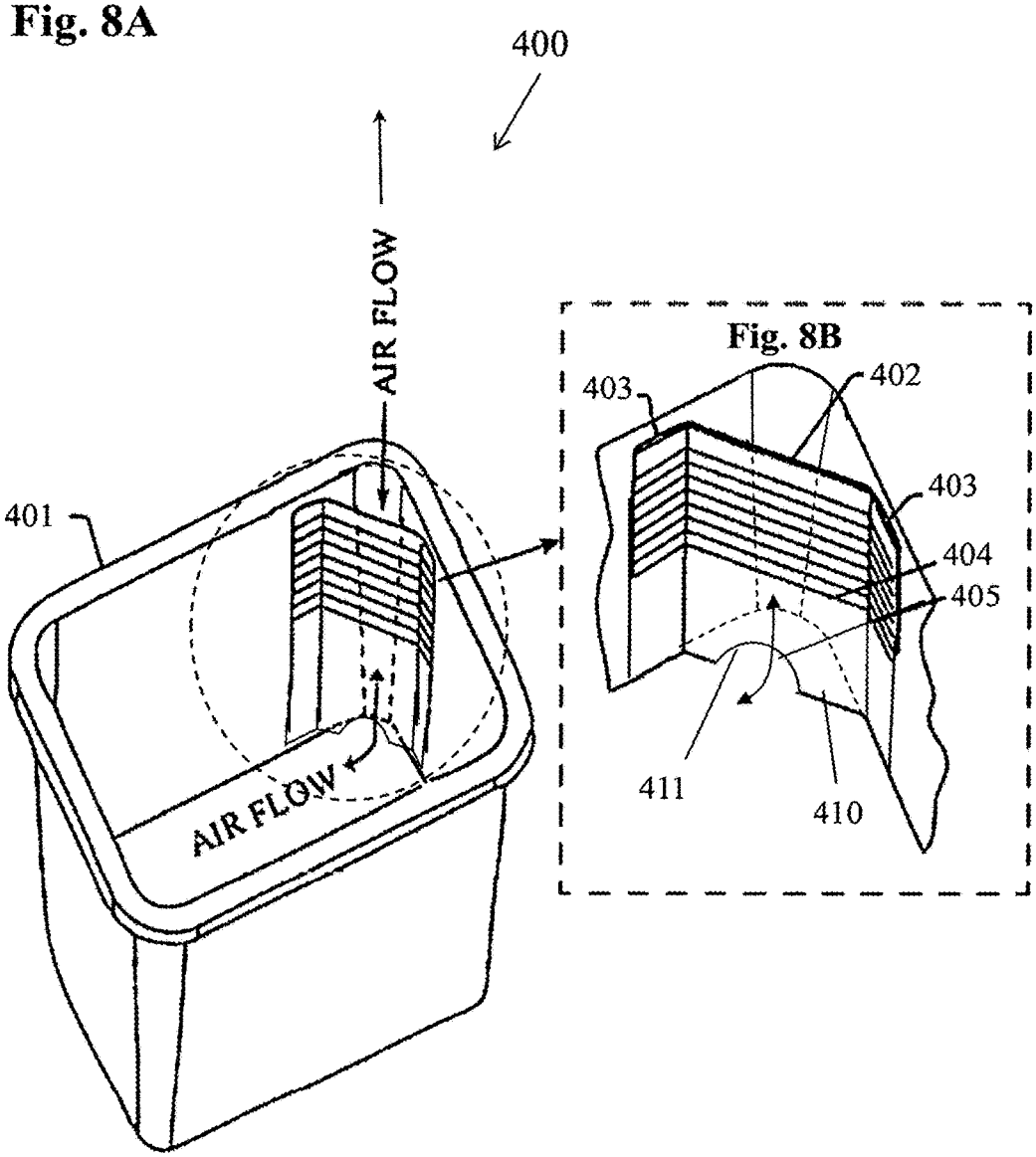
FIG. 8A illustrates another embodiment of the self-venting trashcan system with a detailed exploded view at FIG. 8B.

FIG. 8A illustrates another embodiment of the self-venting trashcan system, shown generally at 400. The typical rectangular trashcan is shown at 401. At one corner, the extruded rigid polymeric strip 402 is placed, the details of which are shown in the exploded view of FIG. 8B. The rigid polymeric strip 402 has two edges bent at an angle, so that it can contact the two smooth sides of the trashcan 401. Two pieces of double-sided pressure sensitive adhesive tape are shown at 403 and are used to secure the rigid polymeric strip 402 against the smooth interior of the trashcan 401. In this optional embodiment the left and right sides with adhesive tape 403 extend all the way to the bottom of the trashcan. The double-sided pressure sensitive adhesive tape may be a foam tape marketed by 3M or others. In the embodiment shown, the rigid polymeric strip 402 includes a plurality of lateral parallel lines 404 locations at which the rigid polymeric strip may be fractured to adjust the height of the rigid polymeric strip prior to double-sided pressure sensitive adhesive tape attachment. The height of the polymeric strip 402 is adjusted to leave a gap 405 between the bottom of the rigid polymeric tip 402 and the bottom of the trashcan 401. In the embodiment shown the rigid polymeric strip 402 has a bottom portion 410 with an arched section 411 so that the polymeric strip is provided with feet/supports at one end to assure the presence of an air passage at the bottom of the trashcan after insertion of the polymeric strip.

Figure 9:
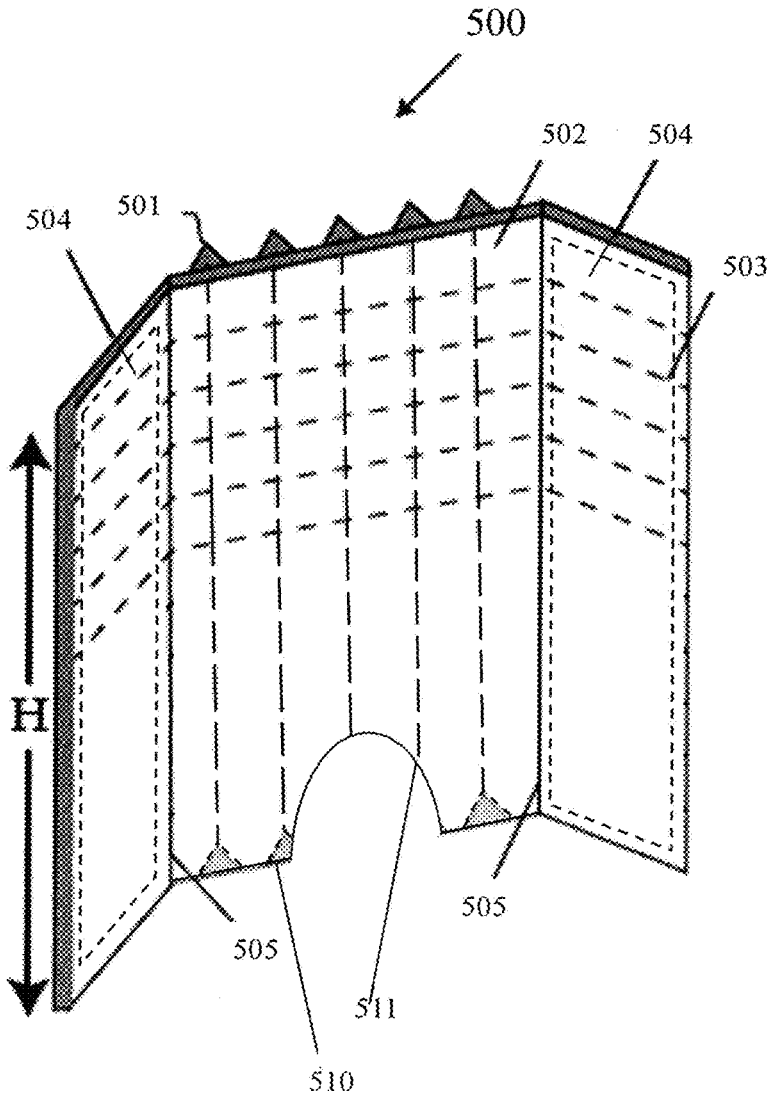
FIG. 9 is an illustration depicting another embodiment showing use of the rigid polymeric strip with ridges along the height direction of the strip.

FIG. 9 is an illustration of the rigid polymeric strip 500 with reinforcing ridges at 501 on the side opposite to side 502 that contacts the trashcan liner preventing the longitudinal flexure or bending of the rigid polymeric strip under the pressure applied by trash contained within the flexible trashcan liner. The reinforcing longitudinal wedges prevent the bending of the rigid polymeric strip even when trash contained within the trashcan liner exerts pressure. The polymeric strip may be cut to different heights 'H' along the easy to cut lateral parallel lines 503. The height 'H' is smaller than the height of the trashcan, leaving a gap between the bottom of the trashcan and the bottom of the rigid polymeric strip. Since the rigid polymeric strip is attached to the smooth side walls of the trashcan using a double-sided pressure sensitive adhesive tape 504 located on the flat left and right portions. The flat left and right portions of the rigid polymeric strip are flexed along flexing lines 505 (for detail on the flexing lines in general, refer to FIGS. 2A-2B) In the embodiment shown the rigid polymeric strip 502 has a bottom portion 510 with an arched section 511 so that the polymeric strip is provided with feet/supports at one end to assure the presence of an air passage at the bottom of the trashcan after insertion of the polymeric strip. In this embodiment, the bottom of the polymeric strip would touch the bottom of trash can.

Figure 10A:
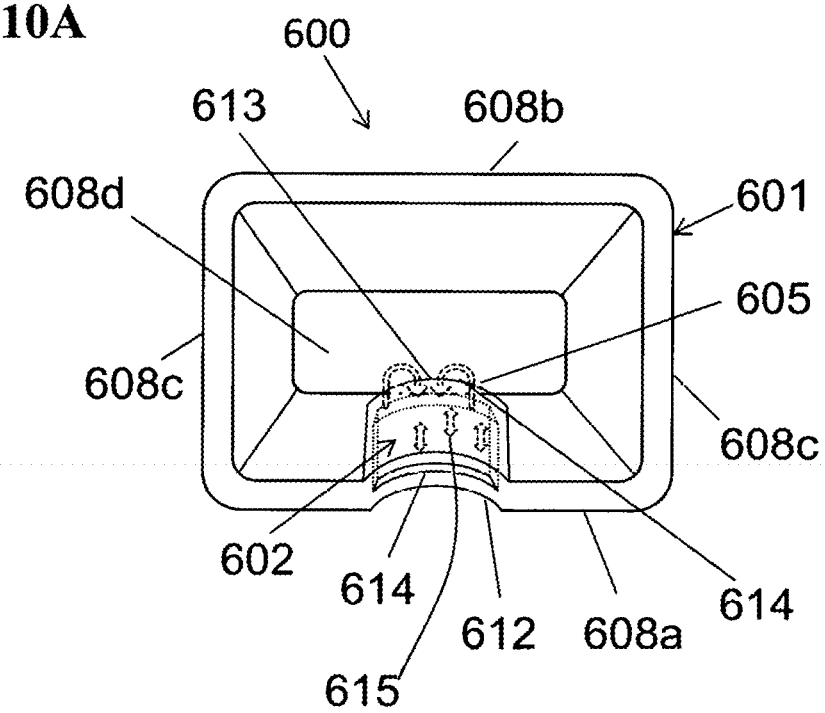
FIG. 10A illustrates a top plan view of another embodiment of the self-venting trashcan system.
Figure 10B:
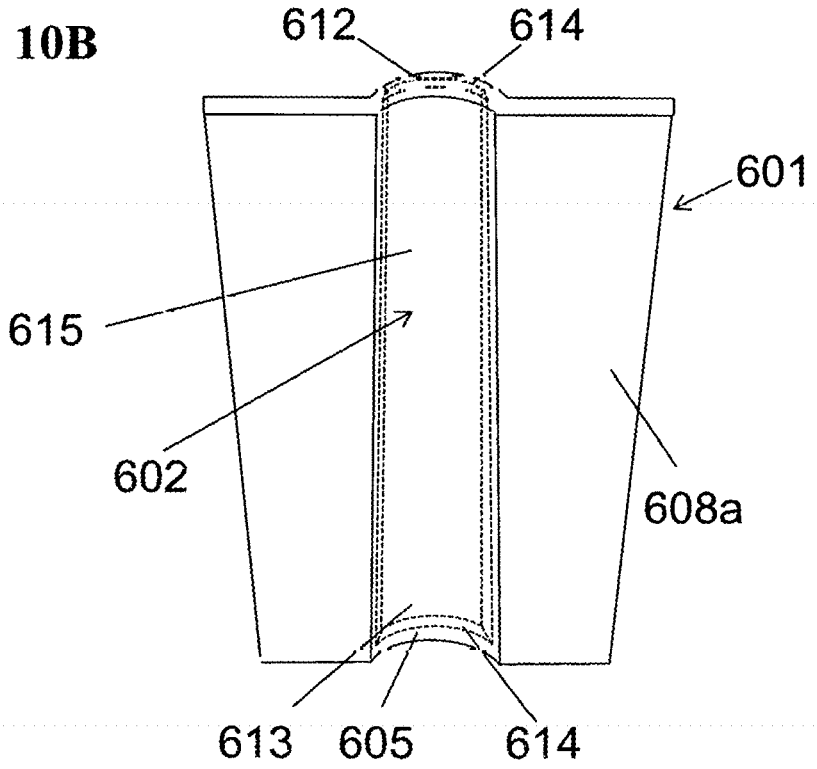
FIG. 10B illustrates a side plan view of the embodiment of FIG. 10A of the self-venting trashcan system.

FIGS. 10A and 10B illustrate views of another embodiment of the self-venting trashcan system having a polymeric strip integrated therewith forming a molded void space integrated within the trashcan in a manner that also provides for stackability of the trashcans as during shipping and/or storage. FIG. 10A illustrates a top plan view of another embodiment of the self-venting trashcan system. FIG. 10B illustrates a side plan view of the embodiment of FIG. 10A of the self-venting trashcan system. Referring to FIGS. 10A and 10B, illustrated generally at 600 are the key elements of this embodiment of the self-venting trashcan system. A rectangular trashcan is shown at 601; it is appreciated that the trashcan can be constructed in a plethora of shapes, sizes, and configurations. Trashcan 601 includes a first wall 608*a*, second wall 608*b*, side walls 608*c*, and a bottom wall 608*d*. Walls 608*a*-608*c* is preferably smooth walls. Preferably, trashcan 601 is composed of a polymeric material.

At least one wall, herein first wall 608*a*, includes a molded rigid polymeric strip 602 (also referred to herein as an air chamber strip) integrated within the structure of the trashcan. Air chamber strip 602 forms an air chamber located centrally within wall 608*a* and extends substantially the full height/height of wall 608*a* leaving a space having a gap 605 between the bottom of the air chamber strip 602 and the bottom 608*d* of the trashcan 601. Air chamber strip/venting channel 602 is preferably constructed having a concave side view and an arched top rim 612 (top view shows the air chamber strip) and concave bottom rim 613. Top rim 612 and/or bottom rim 613 may instead be non-arched. Preferably bottom rim 613 is concave and is located so as to leave gap 605 or a space at or near the bottom wall 608*d*. Apertures 614 are located on top rim 612 and bottom rim 613 with a void or channel 615 extending there between. Void or channel 615 acts as an air chamber or snorkel. Apertures 614 and void or channel 615 have an arched or curved construct as shown. Air chamber strip 602 is preferably concave so that the trashcan 601 can be stacked on other trashcans 601.

Methods to manufacture the trashcan having an integrated air chamber strip may include Rotational Molding; Injection Molding; and Blow Molding, for non-limiting example.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A self-venting trashcan system for use with a trashcan having interior smooth sides and a bottom interior surface, comprising:

a) a rigid strip having a strip height shorter than a height of said side of said trashcan, said rigid strip having left and right sides including a top and a bottom edge with a thin web extending from the top edge to the bottom edge of each left and right side to facilitate bending, both left and right sides having pressure sensitive double sided tape appointed to be attached to the interior smooth sides of said trashcan to form a first air entry/exit pathway;

b) a height setting spacer object appointed to set the smooth rigid strip off the bottom interior surface of the trashcan to ensure a gap between an end of the rigid strip and the bottom interior surface of said trashcan to thereby provide a second air entrance/exit pathway between the end of said rigid strip and the bottom interior surface of said trashcan; and c) said second air entrance/exit pathway allowing trapped air accumulated between a trashcan liner and said trashcan interior surface during placement of the trashcan liner within the trashcan interior to exit through said first air exit pathway, whereby removal of said trash filled trashcan liner for disposal is carried out without vacuum pull back, minimizing the removal effort and tearing of said trashcan liner, and the trashcan liner is readily placed within smooth sidewalls of a trashcan and, when full, removed with reduced effort due to the release of vacuum created between the trashcan liner and the trashcan's smooth interior walls by entry of air through said second air entrance/exit pathway below said rigid strip.

2. The self-venting trashcan system as recited by claim 1, wherein said rigid strip is a rigid polymeric strip.

3. The self-venting trashcan system as recited by claim 1, wherein said trashcan has a cylindrical, circular, half round, half oval, rectangular, square or triangular cross section.

4. The self-venting trashcan system as recited by claim 1, wherein said rigid strip is rigidized by a plurality of longitudinal ribs present on the rigid strip on the surface opposite to the smooth surface that contacts the trashcan liner.

5. The self-venting trashcan system as recited by claim 1, wherein said rigid strip is made from extruded acrylonitrile butadiene styrene polymer.

6. The self-venting trashcan system as recited by claim 1, wherein said rigid strip is made from an extruded high molecular weight polyethylene polymer.

7. The self-venting trashcan system as recited by claim 1, wherein said rigid strip is made from extruded high molecular weight polyvinylchloride polymer.

8. The self-venting trashcan system as recited by claim 1, wherein said rigid strip is made from polymer coated wood, metal, cardboard, or fiberboard.

9. The self-venting trashcan system as recited by claim 1, wherein said double-sided pressure sensitive adhesive tape is a foam tape.

10. The self-venting trashcan system as recited by claim 1 wherein said double-sided pressure sensitive adhesive tape is a commercially available product.

11. The self-venting trashcan system as recited by claim 1, wherein said rigid strip and said double sided pressure sensitive adhesive tape comprise a kit and are attachable to a trashcan of any shape with smooth interior surfaces, said kit being marketed as a combination of a height adjustable rigid strip with a plurality of parallel easy to fracture lines along its height and having bent portions provided on left and right sides, and a double sided pressure sensitive adhesive tape.

12. The self-venting trashcan system as recited by claim 1, wherein the trashcan is a molded part having integrally molded therein the rigid strip providing a chamber that includes a gap between the bottom of the trashcan and the rigid strip, providing self-venting capability.

13. The self-venting trashcan system as recited by claim 12, wherein each side of the trashcan and each wall of the chamber is inclined, clearing the rigid strip when the trashcan is stacked one above the other.

14. The self-venting trashcan system as recited by claim 1, wherein the rigid strip has a bottom portion with an arced or concave section forming feet supports.

15. The self-venting trashcan system as recited by claim 1, wherein the rigid strip comprises feet supports.

16. The self-venting trashcan system as recited by claim 1, wherein the rigid strip is adjustable by fracture at easy-to-fracture parallel lines perpendicular to its height to be shorter than the height of said trashcan, to thereby provide a second air entrance/exit pathway between an end of said extruded polymeric strip and the bottom interior surface of said trashcan.

17. A self-venting trashcan system, comprising:

a) a trashcan with smooth interior;

b) an extruded rigid polymeric strip attachable by attachment means on left and right sides of said polymeric strip to the interior smooth sides of said trashcan, forming a first air entry/exit pathway;

c) said extruded rigid polymeric strip length being adjustable by fracture at easy-to-fracture parallel lines to be shorter than the height of said trashcan, thereby providing a second air entrance/exit pathway between said extruded polymeric strip and the bottom interior surface of said trashcan; and d) said second air entrance/exit pathway allowing trapped air accumulated between said trashcan liner and trashcan interior surface during first placement of the trashcan liner within the trashcan interior to exit through said first air exit pathway, whereby removal of said trash filled trashcan liner for disposal is carried out without vacuum pull back, minimizing the removal effort and tearing of said trashcan liner, and the trashcan liner is readily placed within smooth sidewalls of a trashcan and, when full, removed with reduced effort due to the release of vacuum created between the trashcan liner and the trashcan's smooth interior walls by entry of air through said second air entrance/exit pathway below said extruded polymeric strip.

18. An improvement for use with a trashcan having interior smooth sides and a bottom interior surface, the improvement comprising:

a) an extruded rigid polymeric strip having attachment means on left and right sides of said polymeric strip appointed to be attached to the interior smooth sides of said trashcan, to form a first air entry/exit pathway;

b) said extruded rigid polymeric strip height being adjustable by fracture at easy-to-fracture parallel lines perpendicular to its height to be shorter than the height of said trashcan, to thereby provide a second air entrance/exit pathway between an end of said extruded polymeric strip and the bottom interior surface of said trashcan; and c) said second air entrance/exit pathway allowing trapped air accumulated between a trashcan liner and said trashcan interior surface during placement of the trashcan liner within the trashcan interior to exit through said first air exit pathway, whereby removal of said trash filled trashcan liner for disposal is carried out without vacuum pull back, minimizing the removal effort and tearing of said trashcan liner, and the trashcan liner is readily placed within smooth sidewalls of a trashcan and, when full, removed with reduced effort due to the release of vacuum created between the trashcan liner and the trashcan's smooth interior walls by entry of air through said second air entrance/exit pathway below said extruded polymeric strip.

19. A method of using a self-venting trashcan system, comprising the steps of:

a) breaking a rigid polymeric strip into a height shorter than the height of the trashcan, said break being made at an easy-to-break lateral parallel line perpendicular to the height of said rigid polymeric strip;

b) attaching a first side of a double-sided pressure sensitive adhesive tape and attaching it to each of left and right bent portions of the rigid polymeric strip extending longitudinally thereof;

c) attaching a second side of the double-sided pressure sensitive adhesive tape on both the left and right bent portions of the polymeric strip against the smooth side walls of the trashcan to form a first air entry/exit pathway, and leaving a gap between the bottom of the rigid polymeric strip and the bottom interior surface of the trashcan that forms a second air entrance/exit pathway;

d) placing a trashcan liner within the trashcan, now fitted with self-venting first and second air entry/exit pathways;

e) smoothening air pockets between the trashcan liner and smooth side walls of said trashcan expelling trapped air through a gap between the bottom of the rigid polymeric strip and the bottom interior surface of the trashcan; and f) filling the trashcan liner with trash and pulling out the trash filled trashcan liner, whereby the trashcan liner contacts the smooth interior of the trashcan without air pockets and can be pulled out without vacuum pull-back.

* * * * *